United States Patent [19]

Bowerman

[11] 4,194,310

[45] Mar. 25, 1980

[54] ATHLETIC SHOE FOR ARTIFICIAL TURF WITH MOLDED CLEATS ON THE SIDES THEREOF

[75] Inventor: William J. Bowerman, Eugene, Oreg.

[73] Assignee: BRS, Inc., Beaverton, Oreg.

[21] Appl. No.: 955,784

[22] Filed: Oct. 30, 1978

[51] Int. Cl.[2] ..... A43B 5/02; A43B 13/04; A43B 23/28

[52] U.S. Cl. ..... 36/128; 36/32 R; 36/59 R

[58] Field of Search ..... 36/129, 128, 127, 32 R, 36/59 R, 59 C, 67 R, 7.3, 102, 28, 7.6, 7.7, 11.5, 126

[56] References Cited

U.S. PATENT DOCUMENTS

| | | | |
|---|---|---|---|
| 1,506,662 | 8/1924 | Peller | 36/7.6 |
| 2,063,227 | 12/1936 | Calvin | 36/11.5 |
| 2,179,942 | 11/1939 | Lyne | 36/127 |
| 2,405,498 | 8/1946 | Gregg | 36/32 R |
| 2,878,592 | 3/1959 | Cisko, Jr. | 36/126 |
| 3,793,750 | 2/1974 | Bowerman | 36/59 C |
| 4,043,058 | 8/1977 | Hollister et al. | 36/102 |

FOREIGN PATENT DOCUMENTS

| | | | |
|---|---|---|---|
| 697356 | 11/1965 | Italy | 36/7.3 |

*Primary Examiner*—Patrick D. Lawson
*Attorney, Agent, or Firm*—Klarquist, Sparkman, Campbell, Leigh, Hall & Whinston

[57] ABSTRACT

Athletic shoes with molded cleats of resilient material for use on artificial turf or other hard surfaces are disclosed including first cleats provided on the bottom of the shoe sole positioned beneath the foot of the wearer and second cleats provided on both sides of the shoe. The second cleats are molded integral with a cover strip of resilient material bonded to the outer surface of the shoe upper at its lower edge so as to extend around the toe portion, along the opposite sides and around the heel portion of the shoe upper. Such second cleats provide added traction and enable more rapid changes in running direction, such as when playing football, baseball or soccer, especially under wet conditions. The cover strip may be a separate strip from the outer sole or may be a border portion formed integral with such outer sole layer of less thickness than such outer sole layer. The second cleats are preferably of smaller size and may be of different shape from the first cleats.

15 Claims, 6 Drawing Figures

ATHLETIC SHOE FOR ARTIFICIAL TURF WITH MOLDED CLEATS ON THE SIDES THEREOF

BACKGROUND OF THE INVENTION

The subject matter of the present invention relates generally to athletic shoes for use on artificial turf or other hard surfaces including roads. The invention is directed to such an athletic shoe with molded cleats provided on the sides of such shoe, as well as on the bottom of the outer sole, for added traction. The athletic shoes of the present invention are especially useful on artificial turf under wet conditions for playing football, soccer, baseball and other games requiring rapid changes of running direction.

Previously, it has been proposed in U.S. Pat. No. 2,878,592 of Cisko, Jr., granted Mar. 24, 1959, to provide baseball shoes with metal spikes including additional spikes provided on one side of the shoe to aid in base running. However, these shoes are not suitable for use on artificial turf because they do not employ cleats of resilient material and are not provided with cleats on both sides of the shoe to enable quick turning in either direction. Similarly, U.S. Pat. No. 2,179,942 of Lyne, granted Nov. 14, 1939, shows a golf shoe for use on natural grass which employs additional metal spikes on one side of one shoe. U.S. Pat. No. 1,506,662 of Peller, granted Aug. 26, 1924, shows a similar teaching with respect to a shoe protector having metal spikes provided on the side of such shoe so it would not be suitable for use on artificial turf.

Previously it has been proposed in U.S. Pat. No. 3,793,750 of Bowerman, granted Feb. 26, 1974, and corresponding ASTROGRABBER football shoes sold by BRS, Inc., and in U.S. Pat. No. 4,043,058 of Hollister et al, granted Aug. 23, 1977, to provide an athletic shoe for use on artificial turf with molded polygon-shaped cleats of resilient material provided on the bottom of the outer sole of such shoe. In these shoes, the outer sole extends upward over a portion of the heel and toe portion of the shoe upper. However, such shoes did not employ second cleats on a resilient cover strip of less thickness than the outer sole and which extends around the entire lower edge of the shoe upper. Unlike the shoes of these prior patents, the cover strip of the present shoe covers the entire midsole and heel lift layers as well as the entire lower edge of the shoe upper. Furthermore, since the cover strip is of less thickness it can easily wrap around the bottom of the shoe upper and the outer sole for more secure bonding thereto, and the outer sole layer can be made of greater thickness for increased wear and greater cushioning.

It has been previously known to apply conventional walking shoes, including the shoes shown in U.S. Pat. No. 2,405,498 of Gregg, granted Aug. 6, 1946, and U.S. Pat. No. 2,063,227 of Calvin, granted Dec. 8, 1936, with ribs or projections on the bottom and/or side of the shoe sole, or on foxing covering such sole and the bottom portion of the shoe upper. However, these ribs are not in the form of cleats which are laterally and longitudinally spaced from each other along the sole to provide better traction for movement in both longitudinal and lateral directions. Also, in the case of the latter patent, no molded projections or cleats of any kind are employed on the bottom of the shoe sole. Thus, both of these shoes are totally unsuitable as an athletic shoe for use on artificial turf.

SUMMARY OF INVENTION

It is therefore one object of the present invention to provide an improved athletic shoe for use on artificial turf and other hard surfaces which employs molded cleats of resilient material on the bottom of the shoe and on both sides thereof for greater traction.

Another object of the present invention is to provide such an athletic shoe having an outer sole layer of resilient material with a plurality of first cleats molded integral therewith on the bottom of such sole layer and the side cleats are provided as a plurality of second cleats molded integral with a cover strip of resilient material adhered securely to the bottom edge of the shoe upper.

Still another object of the invention is to provide such a shoe in which the cover strip is a separate member from the outer sole layer for ease of manufacture.

A further object of the present invention is to provide such an athletic shoe of greater strength in which the cover strip is formed as a border portion of the outer sole layer but of less thickness by molding such cover strip integral with the outer sole layer.

An additional object of the invention is to provide such an athletic shoe in which the second cleats are of smaller size and/or different shape from the first cleats on the bottom of the outer sole for greater versatility.

Still another object of the invention is to provide a football shoe of such construction with straight sided polygon-shaped cleats for greater traction on artificial turf under wet conditions.

DRAWINGS

Other objects and advantages of the present invention will be apparent from the following detailed description of certain preferred embodiments thereof and from the attached drawings, of which:

DESCRIPTION OF PREFERRED EMBODIMENTS

Figure 1:
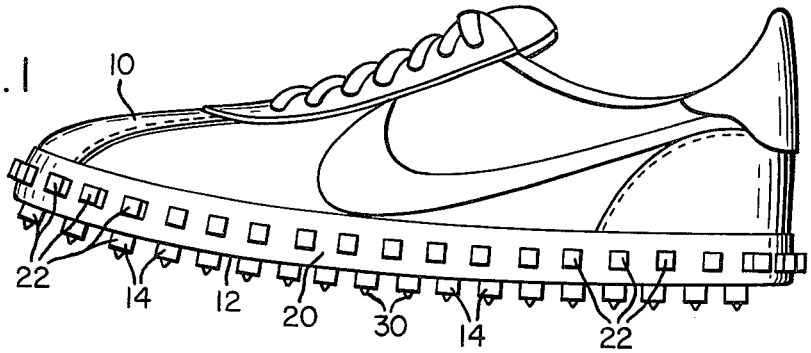
FIG. 1 is a side elevation view of an athletic shoe made in accordance with one embodiment of the present invention.

As shown in FIG. 1, one embodiment of the present invention is an athletic shoe including a shoe upper 10 of leather or synthetic fabric such as nylon. A multi-layered sole is attached to the bottom of the upper including an outer sole layer 12 having a plurality of first cleats 14 of resilient material, such as rubber, molded integral with such outer sole. Preferably, the first cleats 14 have ground engaging surfaces 16 in the shape of straight-sided polygons, such as the square shaped cross section shown in FIG. 2, to provide improved traction as discussed in my previous U.S. Pat. No. 3,793,750. Alternatively, the ground engaging surfaces 16 of such cleats may be in the form of a rectangle, triangle, hexagon or irregular shaped polygon. The straight sides of these cleats grip the artificial turf more securely, especially under wet conditions.

Figure 3:
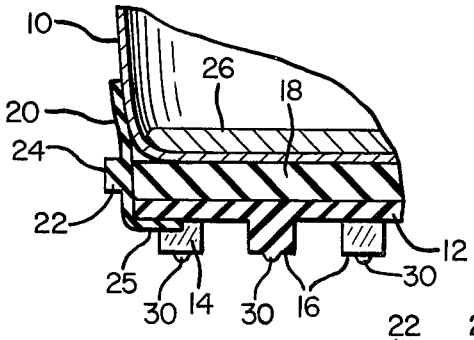
FIG. 3 is an enlarged partial vertical section view taken along line 3—3 of FIG. 1.

As shown in FIG. 3, a cushion midsole layer 18 of foam rubber or other resilient material is provided between the outer sole layer 12 and the shoe upper 10. This midsole layer is of less density and less hardness than the outer sole layer to provide greater cushioning, while the outer sole has longer wearing characteristics due to its greater hardness. In addition, while not shown, a heel lift layer may be employed beneath the arch and heel of the foot in order to elevate the heel to prevent injury to the Achilles tendon. The heel lift layer is provided preferably between the midsole layer 18 and the outer sole layer 12.

In accordance with the present invention, a cover strip 20 of resilient material having a plurality of second cleats 22 molded integral therewith is attached to the opposite sides of the shoe upper as well as around the toe portion and heel portion of such upper. These second cleats 22 may each have a polygon-shaped ground engaging surface 24 and greatly improve traction when the athletic shoe is used for sports such as baseball, football or soccer requiring lateral movement and rapid changes in direction during which the shoe is partially twisted or rolled sideways so that such second cleats engage the artificial turf or other hard surface.

Figure 4:
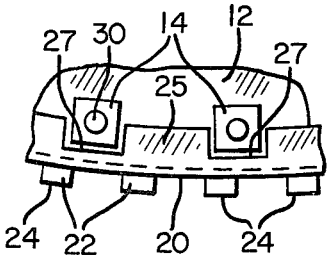
FIG. 4 is an enlarged view of a portion of FIG. 2.

As shown in FIG. 3, in one embodiment of the invention the cover strip 20 may be in the form of a separate member from the outer sole 12, and may be of a lesser thickness than the outer sole in the land areas of the strip surrounding the cleats. This enables more secure bonding of the cover strip to the lower edge portion of the shoe upper 10 and to the outer edge of the midsole 18 and to the land areas of the outer sole 12 by bonding with a suitable glue such as a rubber cement. Thus, the lower edge 25 of the cover strip is folded over the outer edge of the sole 12 and has notches 27 cut out of such edge which are aligned with cleats 14 so that such cover strip is bonded only to the land areas of such sole and does not cover the cleats, as shown in FIG. 4. It should be noted that the first cleats 14 are positioned beneath the foot of the wearer in the toe, heel and arch areas and such cleats are spaced apart laterally and longitudinally across the sole to provide good traction in both longitudinal and lateral directions of movement, while at the same time providing additional cushioning. The second cleats 22 on the side of the shoe upper provide no cushioning during normal straight ahead running, but are primarily for providing additional traction during lateral movement or changes in running direction. Therefore such second cleats do not have to be as large as the first cleats and the projection height of such first cleats above the surrounding land areas may be greater than that of the second cleats. Also, the ground engaging surface 16 of the first cleats may be of greater area and a different polygon shape than the ground engaging surface 24 of such second cleats.

As shown in FIG. 3, a conventional insole layer 26 may be provided inside the shoe upper and bonded to the upper surface of the bottom portion of such shoe upper for additional comfort and to prevent blistering. Such insole may be made of a layer of foam rubber material with a covering of nylon or other fabric on its upper surface.

Figure 2:
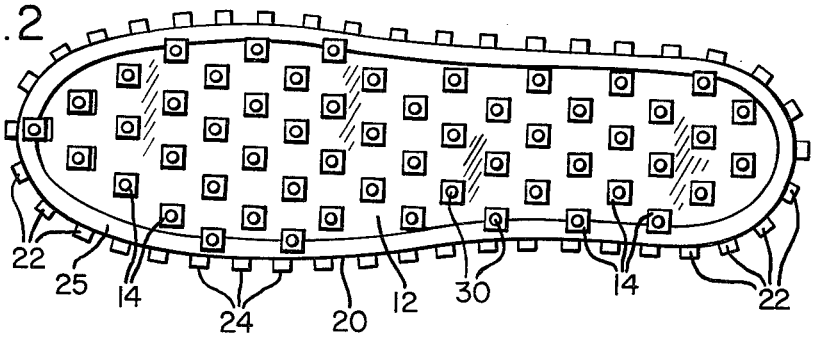
FIG. 2 is a plan view of the bottom of the shoe of FIG. 1.
Figure 6:
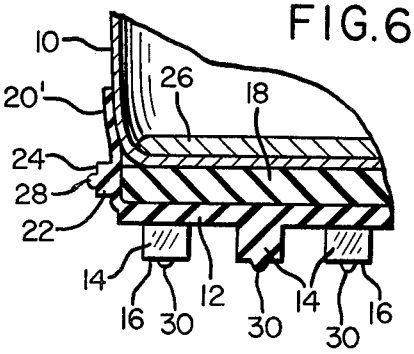
FIG. 6 is an enlarged partial vertical section view similar to FIG. 3 but for a second embodiment of the athletic shoe using the sole of FIG. 5.
Figure 5:
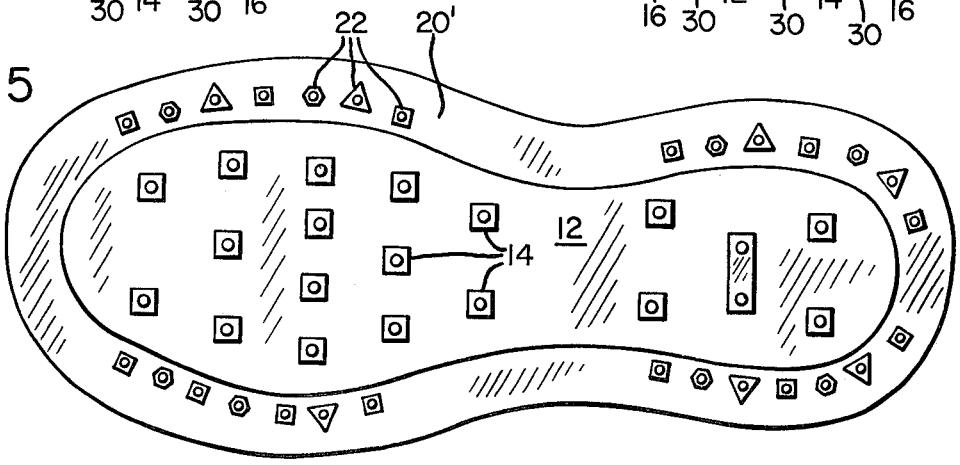
FIG. 5 is a plan view of an outer sole and integral cover strip for an athletic shoe made in accordance with another embodiment of the present invention.

While the embodiment of the invention shown in FIGS. 1, 2 and 3 is satisfactory under most conditions, it may be preferable to form the cover strip as a cover strip portion 20' formed integral with the outer sole layer 12, as shown in the embodiment of FIGS. 5 and 6. Thus, in this embodiment the cover strip 20' is in the form of a thin border portion surrounding the outer sole layer 12 and joined thereto by molding it integral with such outer sole in the same molding process by which the cleats 14 and 22 are made. The integral cover strip 20' is of lesser thickness than the outer sole layer 12 which may be about two or three times the thickness of such cover strip in the land areas surrounding the cleats.

As shown in FIG. 4 the second cleats 22 need not be provided for the arch portions of the cover strip 20' on the inside and outside of the shoe, since there is very little need for traction in those areas. It should be noted that in the embodiment of FIGS. 1, 2 and 3 the cover strip 20 is in the form of a separate strip member with the second cleats 22 uniformly spaced along it so that such cover strip may be cut from a long roll of strip material in the proper length to encircle the shoe upper during manufacture. However, in the embodiment of FIGS. 5 and 6, the cover strip 20' is molded integral with the outer sole and is merely folded upward and bonded to the shoe upper and to the midsole layer 18. As a result, the integral cover strip 20' of FIGS. 5 and 6 is more securely bonded to the outer sole layer and does not tend to separate from the shoe during use as readily as the cover strip in the embodiment of FIGS. 1, 2 and 3. Of course, the embodiment of the sole in FIG. 5 and 6 must be molded with special molds for each shoe size, where the embodiment of FIGS. 1, 2 and 3 can be cut from a large sheet of outer sole material and is therefore more economical to manufacture.

It should be noted that when the cover strip 20' is molded integral with the outer sole 12, the ground engaging surface 24 of the second cleats 22 is formed with a small projection 28 at its center as a result of providing a hole in the cleat mold cavity for aiding release of the cleat from such mold cavity. The ground engaging surfaces 16 of the first cleats 14 are also provided with similar small central projections 30 for the same reason. These projections 28 and 30 quickly wear away in use until the ground engaging surfaces 24 and 16 are substantially flat.

It will be obvious to those having ordinary skill in the art that many changes may be made in the details of the preferred embodiments of the present invention without departing from the spirit of the invention. Therefore, the scope of the present invention should only be determined by the following claims.

I claim:

1. An athletic shoe comprising:

a shoe upper, a shoe sole attached to said shoe upper;

said shoe sole including an outer sole layer of resilient material having a plurality of first cleats molded integral with said outer sole layer, said first cleats being spaced laterally and longitudinally along said sole, and positioned beneath the foot of the wearer; and a cover strip of resilient material of less thickness than said outer sole layer adhered to the shoe upper, said cover strip extending partially over the outer surface of said shoe upper around the toe portion and along the opposite sides of the shoe upper and having a plurality of second cleats molded integral with said cover strip on the opposite sides of said shoe upper.

2. An athletic shoe in accordance with claim 1 in which the cover strip extends completely around the bottom of the shoe upper including the arch portion and the heel portion of said upper.

3. An athletic shoe in accordance with claim 2 in which the cover strip is of a narrow width providing a row of said second cleats and extends over the junction between the shoe upper and an intermediate sole layer of less hardness than the outer sole layer.

4. An athletic shoe in accordance with claim 1 in which at least some of the second cleats are of shorter projection height than said first cleats.

5. An athletic shoe in accordance with claim 1 in which the cover strip is formed integral with the outer sole layer but is of less thickness than said outer sole layer.

6. An athletic shoe in accordance with claim 1 in which the cover strip is a separate member from the outer sole layer.

7. An athletic shoe in accordance with claim 1 in which said first and second cleats have their outer ends in the form of straight sided polygons.

8. An athletic shoe for artificial turf, comprising:

a shoe upper, a shoe sole attached to said shoe upper;

said shoe sole including an outer sole of resilient material having a plurality of first cleats molded integral with said outer sole, said first cleats being spaced apart laterally and longitudinally along said sole and positioned beneath the foot of the wearer; and a cover strip of resilient material adhered to the outside of the shoe upper and extending around the toe portion, the heel portion and along the opposite sides including the arch portion of said upper, said cover strip having a plurality of second cleats molded integral with said cover strip on the opposite sides of the shoe upper.

9. A shoe in accordance with claim 8 in which the second cleats are of less projection height than said first cleats.

10. A shoe in accordance with claim 8 in which the second cleats are of less ground engaging surface area than said first cleats.

11. A football shoe in accordance with claim 8 in which the cover strip is of less thickness than the outer sole.

12. A football shoe in accordance with claim 11 in which the cover strip is formed integral with said outer sole but is of less thickness than said outer sole.

13. A football shoe in accordance with claim 12 in which the second cleats are positioned on the toe portion and the heel portion but not on the arch portion of the cover strip.

14. A football shoe in accordance with claim 11 in which the cover strip is a separate member from the outer sole and is positioned to extend over the junction between the shoe upper and the shoe sole.

15. An athletic shoe in accordance with claim 8 in which the first and second cleats have their outer ends in the form of straight sided polygons.

* * * * *